US005359832A

United States Patent [19]

Hartman et al.

[11] Patent Number: 5,359,832

[45] Date of Patent: Nov. 1, 1994

[54] ACCUMULATOR AND COLLATOR FOR PACKAGING APPARATUS

[75] Inventors: Donn A. Hartman, Gurnee; William N. Pearson, Highland Park, both of Ill.

[73] Assignee: Cloud Corporation, Des Plaines, Ill.

[21] Appl. No.: 940,521

[22] Filed: Sep. 4, 1992

[51] Int. Cl.[5] ..... B65B 9/08; B65B 61/10

[52] U.S. Cl. ..... 53/435; 53/520; 53/562; 83/236

[58] Field of Search ..... 53/435, 455, 513, 520, 53/562, 567, 568, 77, 52, 64; 83/236, 336

[56] References Cited

U.S. PATENT DOCUMENTS

| | | | |
|---|---|---|---|
| 3,548,695 | 12/1970 | Pearson | 83/236 X |
| 3,680,418 | 8/1972 | Phillips | 83/236 X |
| 4,430,914 | 2/1984 | Keim | 83/236 X |
| 4,545,780 | 10/1985 | Martin | 83/236 X |
| 4,570,418 | 2/1986 | Gino | 53/520 X |
| 5,133,172 | 7/1992 | Soubrier | 53/562 X |

*Primary Examiner*—James F. Coan

*Attorney, Agent, or Firm*—Dorn, McEachran, Jambor & Keating

[57] ABSTRACT

A packaging machine including packaging apparatus to form a chain of connected packages, a cutting station to separate the packages having a controllable variable speed drive, an accumulator between the packaging apparatus and cutting station to accumulate the chain of packages, and control means to vary the speed of operation of the cutting station in response to the accumulation in the accumulator. The accumulator in its preferred form is a conveyor. A unique control device is provided which receives the completed package chain and delivers it for further processing.

63 Claims, 10 Drawing Sheets

FIGURE 14
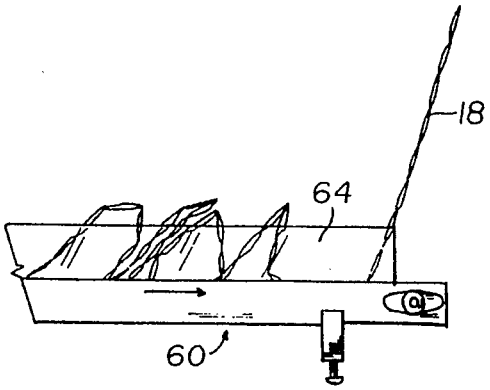
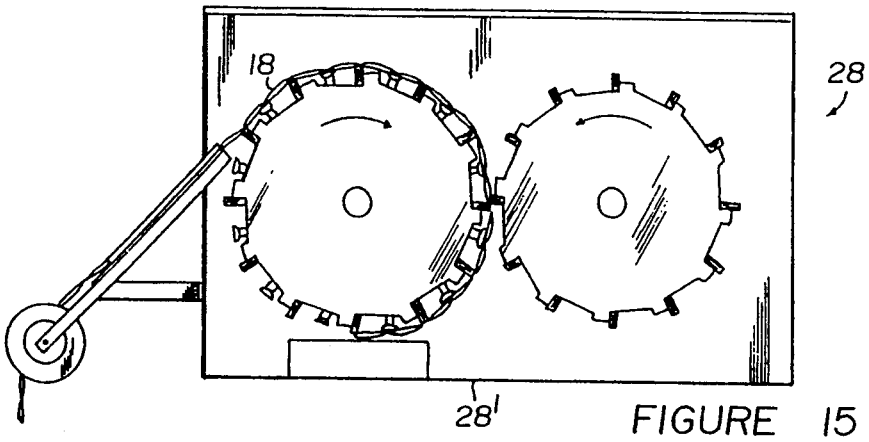
FIGURE 15
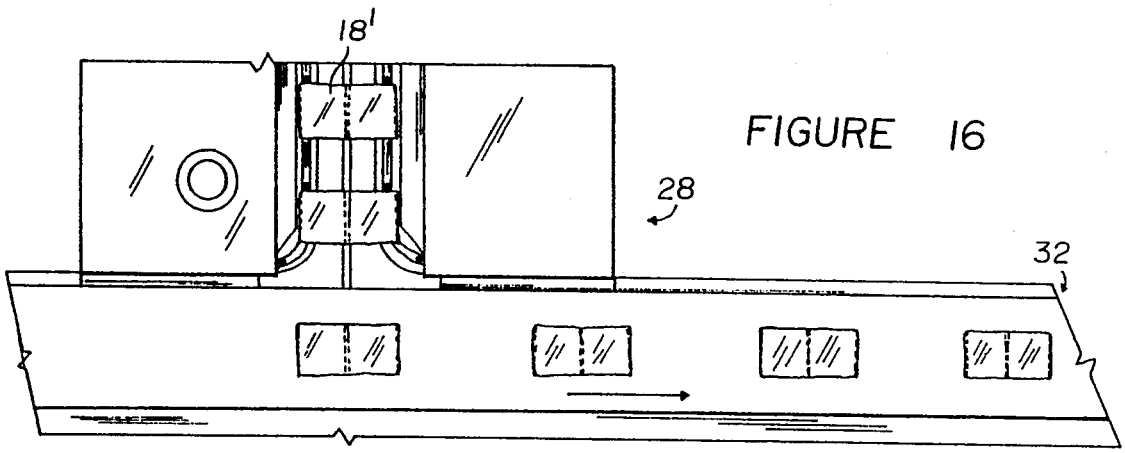
FIGURE 16
FIGURE 17
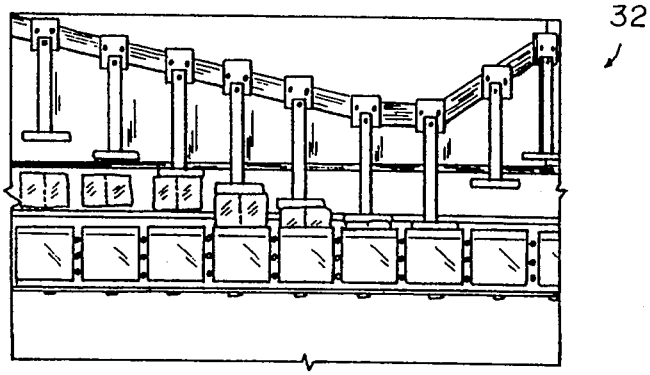

ACCUMULATOR AND COLLATOR FOR PACKAGING APPARATUS

BACKGROUND OF THE INVENTION

1. Field of the Invention

The present invention relates to a method and apparatus for accumulating a series of filled packages formed by a high speed packaging machine. More specifically, the accumulating apparatus is provided to allow for continued creation of filled packages and accumulation of same during periods of downtime for a downstream knife machine and cartoner of the packaging apparatus.

2. Description of the Prior Art

Machines for high speed production of a strip of filled packages are known, exemplary devices being disclosed in the Cloud U.S. Pat. No. 3,597,898 and the Cloud U.S. Pat. No. 5,094,657.

Further, method and apparatus for cutting the strip of packages apart are also known from the Cloud U.S. Pat. No. 3,683,729 and the Cloud U.S. Pat. No. 3,757,620.

Heretofore, the cutting apparatus has been mounted on the packaging machine immediately adjacent an outlet from the packaging machine, with a cartoning machine, or the like, being provided downstream of the cutting apparatus.

Thus, if the cartoner fails, cut apart packages overflow until the packaging and cutting machines are shut down. Not only does overflow develop, but the quantity of packages produced over a specific time period is drastically reduced. Further, the creation of scrap is significantly increased. If, however, means were provided within the apparatus which could accumulate the uncut strips of packaged product during periods of non-function of the cartoner, the quantity of filled packages produced per given time period could be increased significantly. Further, since cartoning can take less time than packaging, the cartoner, once functional again, could catch up cartoning the accumulated product, with downtime of up to 10 minutes being easily accommodated with the packaging machine running at full speed.

Still further, if the packaging machine were run at half speed, 20 minutes of package production could be accommodated before requiring shutdown, with the cartoner being run more quickly once up again to take up the overage or excess.

Inasmuch as it would be preferable for accumulation to take place before cutting apart the series of filled packages, the apparatus and method of the present invention propose relocating the knife or cutting assembly near or onto the cartoner, and interposing speed control and accumulation structure between the packaging machine and the knife or cutting apparatus thereof.

SUMMARY OF THE INVENTION

According to the invention there is provided in a circuitry controlled packaging apparatus of the type including a packaging station, and a cutting station for separating packages produced in chain fashion in the packaging station, the improvement comprising: an accumulator structure functionally engaged between an outlet from the packaging station and an inlet to said cutting station for accumulating thereon, any overflow of chained packages created in the packaging station, within predefined limits, until such overflow is accommodated, such as during times of shutdown.

Further according to the invention there is provided a method of accumulating packages upstream of a cutting station of a packaging machine upon stoppage of said cutting station, said method comprising the steps of:

creating chained packages of product;

feeding said packages into and through a control apparatus which is operable at a rate corresponding to a chosen rate of package creation;

said control apparatus supplying said chained packages onto an accumulator structure;

said packages feeding from said accumulator to a cutting station which severs the chained packages apart;

when said cutting station fails to operate, shutting down operation of said cutting station and accumulating uncut chained packages upon said accumulator for a predetermined time period.

BRIEF DESCRIPTION OF THE DRAWINGS

FIG. 14 shows a strip of packages at an exit end of the accumulator structure.

FIG. 15 shows the strip of packages entering and being cut into separate packages within a cutting or knife station of the apparatus.

FIG. 16 shows the cut apart packages being transported by a pin conveyor onto a belt conveyor which feeds the packages, singly or in stacks, onto a belt conveyor feeding a cartoner station of apparatus.

FIG. 17 shows the packages being cartoned within the cartoner station of the apparatus.

DESCRIPTION OF THE PREFERRED EMBODIMENT

Figure 1:
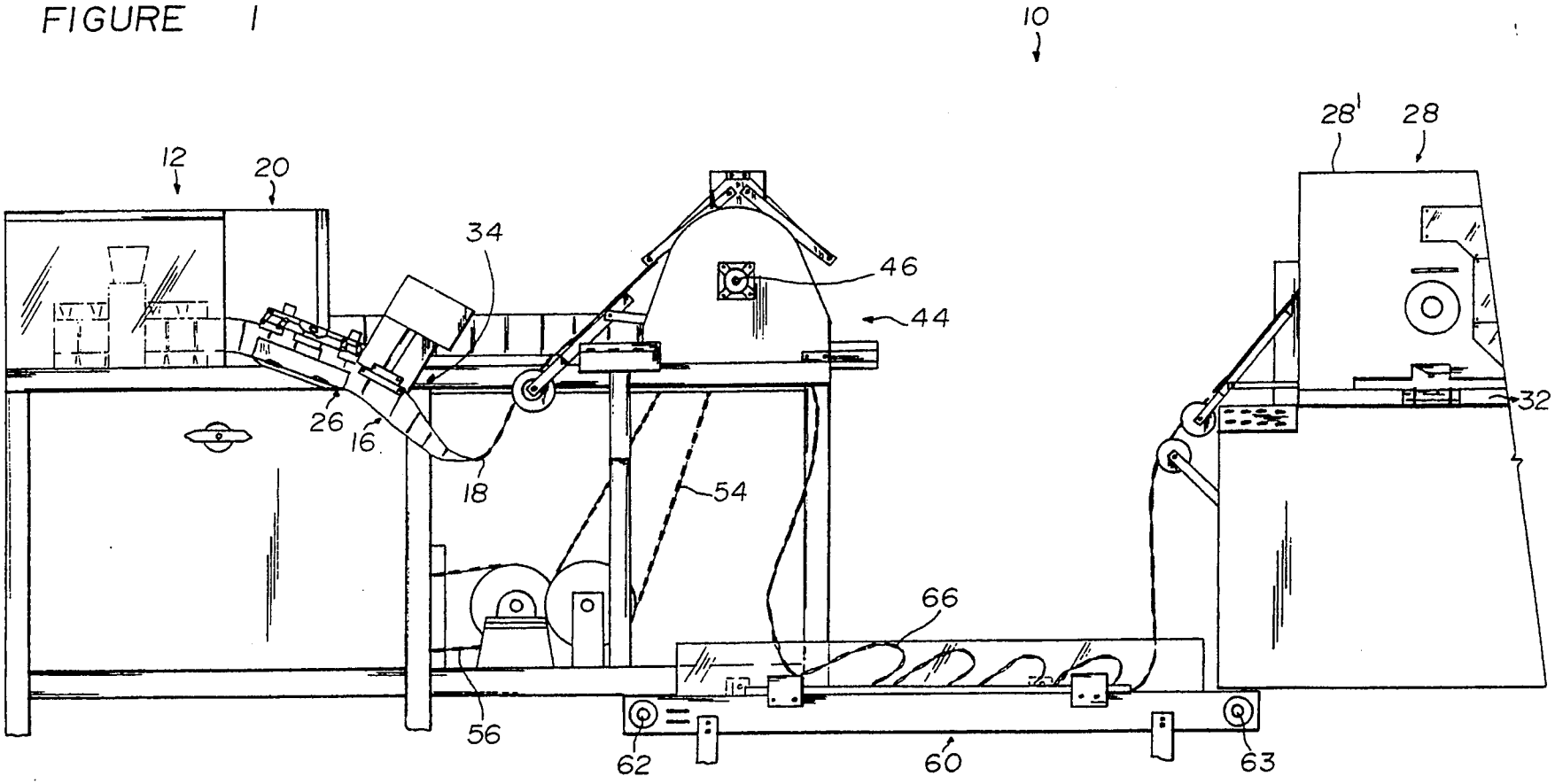
FIG. 1 is a side view of a packaging apparatus made in accordance with the teachings of the present invention.
Figure 2:
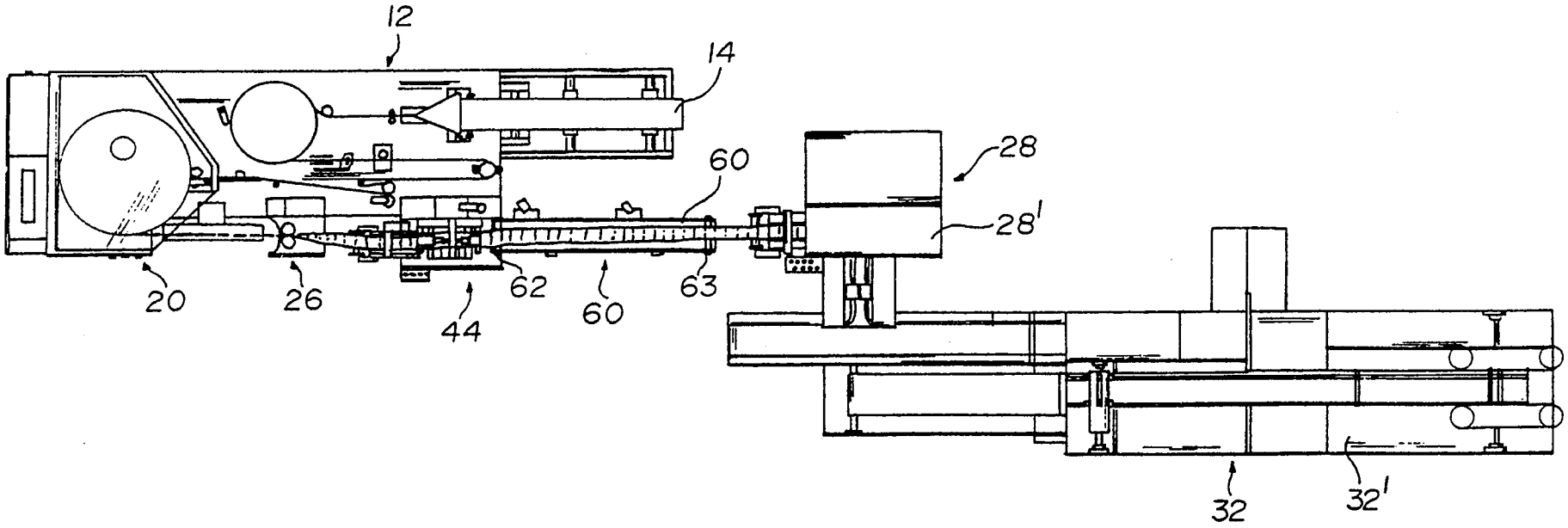
FIG. 2 is a top plan view of the apparatus of FIG. 1.
Figure 3:
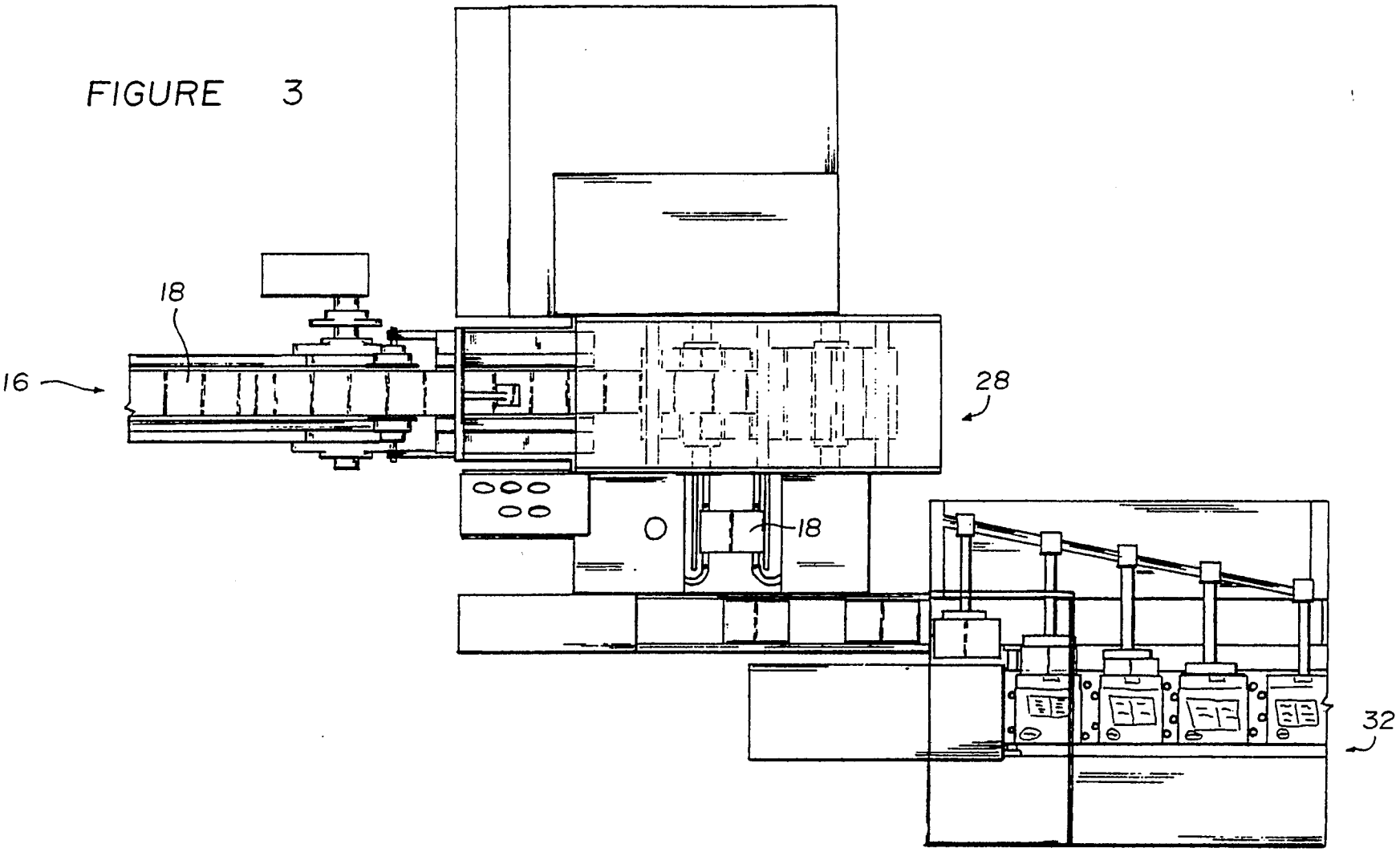
FIG. 3 is an enlarged top plan view of the knife assembly shown adjacent and mounted to the cartoning machine of apparatus.
Figure 6:
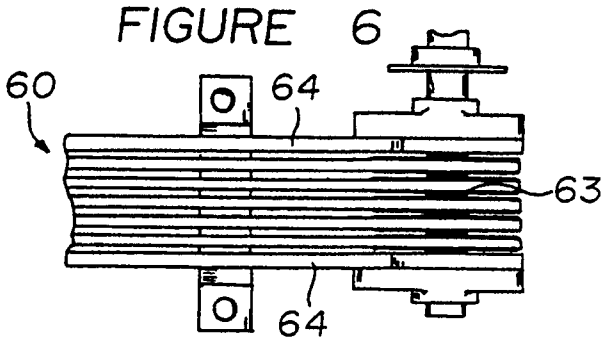
FIG. 6 is a top view of another end of the conveyor of FIG. 4, and shows a banded conveyor belt mounted over an end core thereof.
Figure 7:
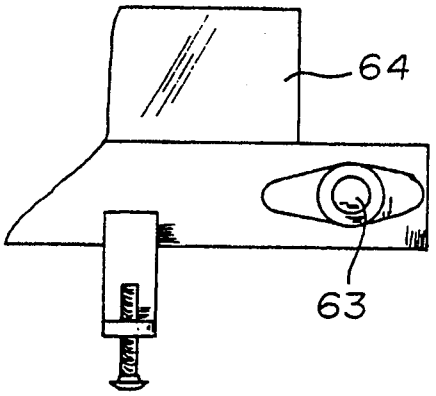
FIG. 7 is a side view of the conveyor end of FIG. 6 showing a continuation of the alignment shoulder of FIG. 5.
Figure 4:
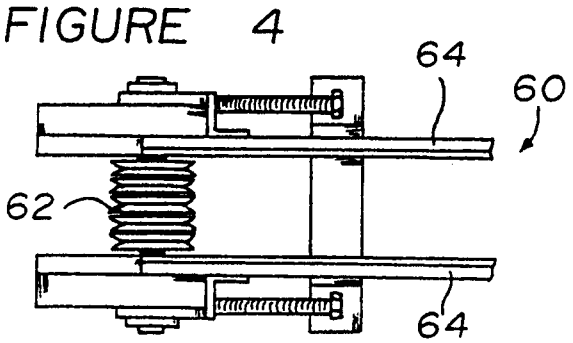
FIG. 4 is a top view of one end core of a conveyor forming a first embodiment of an accumulator structure.
Figure 5:
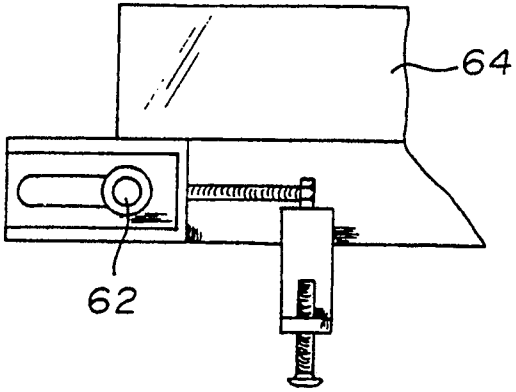
FIG. 5 is a side view of the structure of FIG. 4 showing an alignment shoulder thereof.

Referring now to the drawings in greater detail, there is illustrated therein the packaging apparatus of the present invention generally identified by the reference numeral 10.

As shown, the apparatus 10 incorporates several stations therein. First provided is a package forming station 12, wherein at least one roll of material 14 is processed into a chained strip 16 of three or four sided packages 18. Next, a filling station 20 is provided which fills the partially formed packages 18 with a particular product 22. Once product 22 has been appropriately dispensed into the packages 18, an open edge 24 of the packages 18, through which the product 22 was received, must be closed. This closure of the open package end 24 takes place at a sealing station 26 in known manner.

Typically, once such sealing takes place, the strip 16 of chained, now closed packages 18 immediately would enter a cutting station 28 incorporating a knife machine 28' therein for cutting individual packages 18' from the chained strip 16. These packages 18', or a chosen plurality of same would then be immediately fed to a cartoning station 32, for packing.

As stated hereinbefore, if the cartoning station 32 fails in operation for one reason or another, the cutting station 28 and all upstream stations would have to be shut down, the packages 18' being unable to collect anywhere until the cartoning station 32 was once again functional.

This required shutting down of the entire packaging apparatus 10, as will be easily recognized, cut significantly into profitability, as well as significantly decreasing the number of product filled packages 18, 18' which a packaging apparatus 10 whose cartoning station 32 failed would produce over a given time period.

Thus, the present apparatus 10 was designed to accommodate continued function of all stations upstream of the cutting station 28 for a significant period of time, during downtime periods for a cartoning station 32 of the apparatus 10, and incorporating elements therein which would allow the cutting and cartoning stations, 28 and 32, respectively, upon return to a functional status, to function at a significantly increased pace and with a possibly slowed pace of package production, until the accumulated packages 18 formed during downtime were accommodated, with all stations once again becoming synchronized after such accumulation is accommodated.

The first modification required to allow for means for accumulating packages to be provided was to remove the cutting station 28 from its usual mounting at an outlet end 34 from the sealing station 26. If the cutting station 28 were instead incorporated onto a cartoner 32' at the cartoning station 32, then a hiatus created between the sealing station 26 and the cutting station 28 could accommodate structure therein which could accumulate packages 18 thereon for a preselected time period, with package production 18 being slowed, rather than stopped during periods of cartoning station 32 downtime and with control being provided which would increase cartoning speed upon return to functionality of the cartoner 32' until such accumulation were accommodated.

Inherently, if the cutting station 28 is proposed for mounting onto the cartoner 32' at the cartoning station 32, the knife machine 28' of the cutting station 28 must operate at a rate which corresponds to the rate at which the cartoner 32' functions and therefore, control of knife machine 28' and cartoner 32 function must remain correlated at all times by control circuitry 40 (FIG. 22) provided for the apparatus 10.

With respect to providing means for accumulating packages during downtime periods of the cartoner 32', it will first of all be understood that means for directing output of formed packages 18 must be provided inasmuch as such directing function was heretofore provided by a cutting station 28 mounted thereto.

Figure 12:
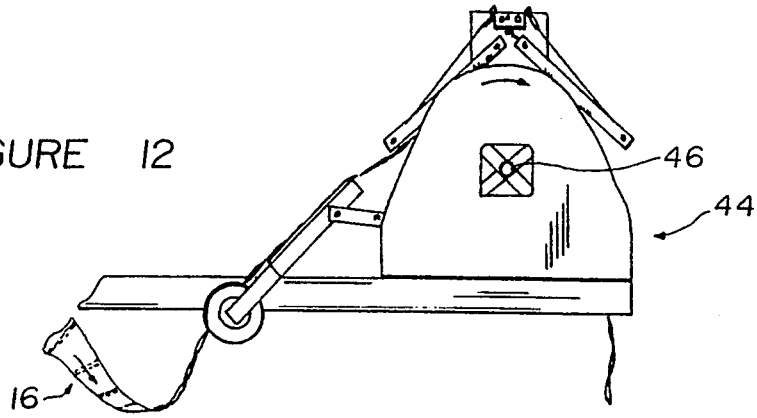
FIG. 12 shows the strip of filled packages being fed into and through a control and alignment system commonly referred to as a squirrel cage.
Figure 13:
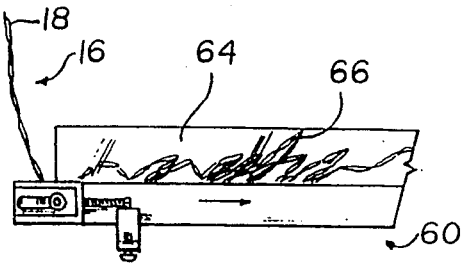
FIG. 13 shows a strip of packages exiting the squirrel cage and accumulating on the accumulator structure of FIG. 1.

Referring to FIGS. 1 and 12, it will be seen that direction, alignment, flow and rate are all necessarily parameters which are to be controlled by structure provided in lieu of the cutting station 28, preferably with the structure proposed being operated in a manner identical to that in which the cutting station 28 was operated so that no significant, costly or time consuming modifications need to be made to the packaging apparatus 10 to accommodate such proposed replacement output control structure.

To accomplish this end, a structure 44 commonly referred to herein as a squirrel cage 44 is provided. The squirrel cage 44 is operated under circuitry 40 control and engages upon a chain driven shaft 46 which previously engaged and operated the knife machine 28'.

As best shown in FIGS. 18–21, the squirrel cage 44 has an internal paddle wheel 48, paddles 50 of the wheel 48 being spaced therearound in a manner to accommodate adjacent chained packages 18. To assure alignment of the chained packages 18, each paddle 50 is provided with a centered radial edge channel 52, with the packages 18 being accommodated within the channels 52. Speed of rotation of the paddle wheel 48 must necessarily correspond to speed of package 18 production and such correspondence may be produced through appropriate mechanical drive correlation.

Figure 22:
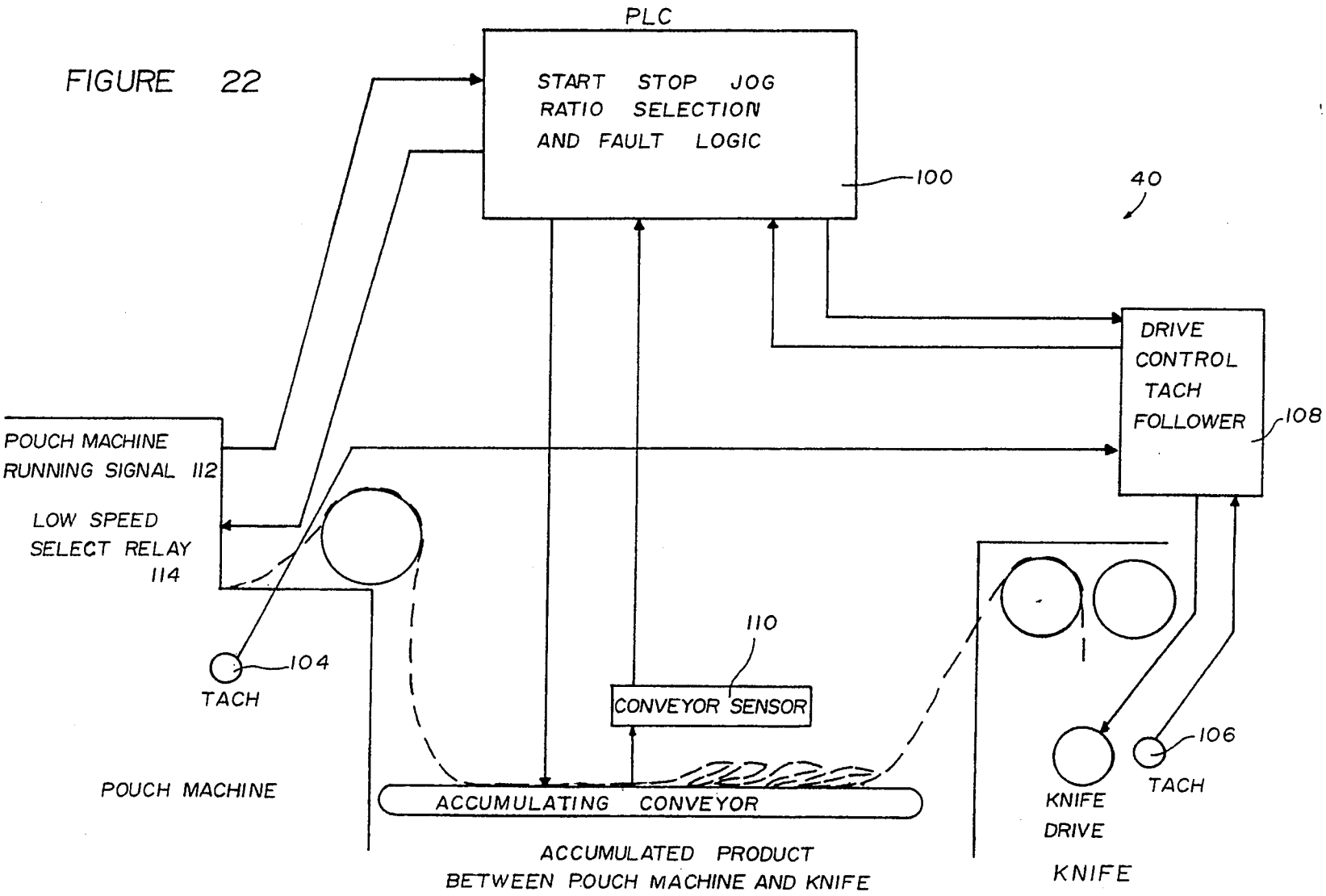
FIG. 22 is a block diagram showing how control of the various stations is accomplished through use of a programmable logic controller.

Inasmuch as such correspondence is required, the wheel 48 is driven by a chain 54 which is operated synchronously with a drive chain 56 of the packaging station 12, as will be shown in detail in describing FIG. 22.

From this squirrel cage 44, the strip 16 of chained packages 18 is fed onto an accumulator 60 which may be of any desired, functional form. For the purposes of simplicity of disclosure, a first form of accumulator is shown to comprise a continuous conveyor belt 60 supported on terminal shafts 62 and 63. Here, the conveyor belt 60 is shown to be made of parallel bands of belt material, though this is not to be construed as limiting.

The conveyor 60 is also provided with side walls 64 used to maintain the packages 18 aligned thereon. The conveyor 60 is driven in any suitable manner, with the speed of the drive being controlled by the circuit 40.

Obviously if packaging is rapid and the conveyor 60 is rapidly moving, the strip 16 of packages will lie more or less prone thereon. However, if the speed of the conveyor 60 is slowed, as would be desired during periods of accumulation, the strip 16 of packages 18 would fold over itself in loops 66. By the formation of such loops 66, it will be understood that a substantial number of packages 18 can be accumulated on the conveyor 60.

As stated previously, the conveyor 60 has been found able to accommodate packages 18 produced during a ten minute period when the packaging station 12 is run at full speed or those produced during a twenty minute period when the packaging station 12 is operated at half speed.

This period of accumulation should allow enough time to reactivate the cartoner 32' after failure without need to cease creating packages 18, increasing productivity and decreasing waste substantially.

It will be understood that any type of accumulator 60 could be provided, so long as placement thereof is upstream of the cutting station 28.

Figure 8:
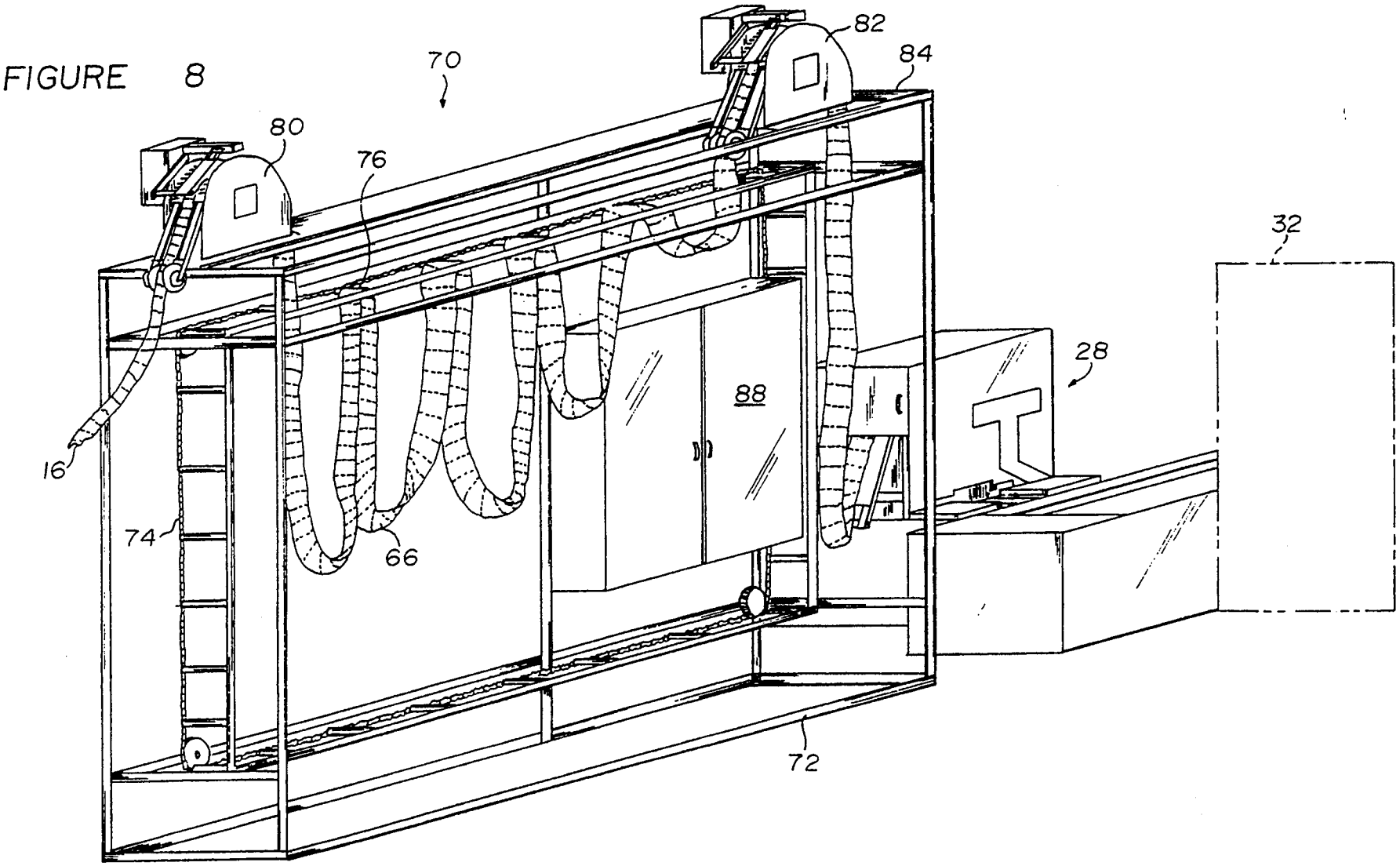
FIG. 8 is a perspective view of a secondary embodiment of an accumulator structure for the apparatus.
Figure 9:
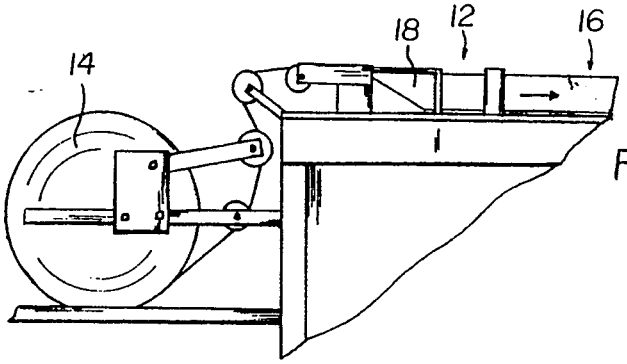
FIG. 9 is a view of the packaging station of the packaging apparatus of FIG. 1 showing a package being formed from a continuous strip of material.
Figure 10:
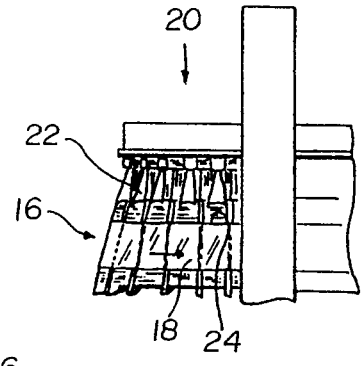
FIG. 10 shows formed packages being filled through an open top end thereof at a filling station of the apparatus.
Figure 11:
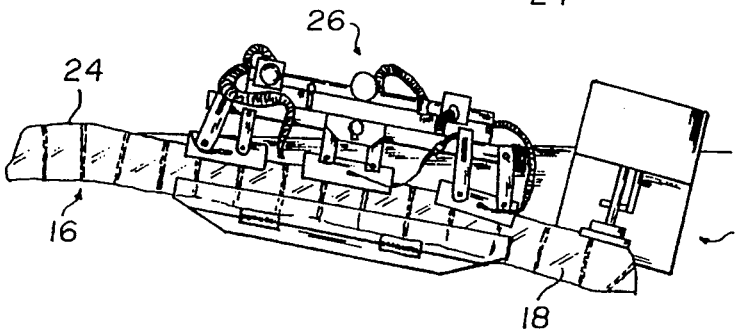
FIG. 11 shows a sealing device sealing the open end of the filled packages at a sealing station of the apparatus.

To underscore adaptability of the apparatus 10, a second embodiment of an accumulator 70 is illustrated in FIG. 8.

Here the accumulator 70 is seen to incorporate a framework 72 within which a driven runged closed loop conveyor 74 is supported.

As shown, loops 66 of a strip 16 of chained packages 18 may be dropped over rungs 76 traversing the top flight of the conveyor 74.

Feeding onto the rungs 76 as well as removal therefrom of the strip 16 must be accomplished in such a manner that no stress is placed on the strip 16 to cause disruption of same.

Accordingly, two control apparatus 80 and 82 are provided, one at either end of the framework 72. These control apparatus 80 and 82 may be equivalent to the squirrel cage 44 previously described.

As shown, the strip 16 is first fed into and through control apparatus 80, which is fixed in place on the framework 72. The strip 16 exits the apparatus 80, falling between rungs 76 moving thereunder until the rungs 76 travel a distance sufficient to cause feeding of the strip 16 into the next slot preceding the adjacent following rung 76. Obviously, the speed of the flight of the conveyor 74 is controlling with respect to the length of the loops 66 formed in this manner; i.e., a slower flight creates longer loops 66 and a faster flight creates shorter loops 66.

At an exit end 84 of the framework 72 the second control apparatus 82 is provided. This control apparatus 82 is movable toward and away from the first apparatus 80, with such movement being controlled by the circuitry 40. Such movement potential is required and must be monitored to prevent disruption of the strip 16, such disruption being prevented by moving the control apparatus 82 into close proximity to the apparatus 80 when essentially no accumulation exists, creating a substantially direct feed between the apparatus 80 and 82.

In this conveyor system 70, because control and operational requirements are rather complex, circuitry for operation of the system 70 is localized within a case 88 therefor.

Figure 18:
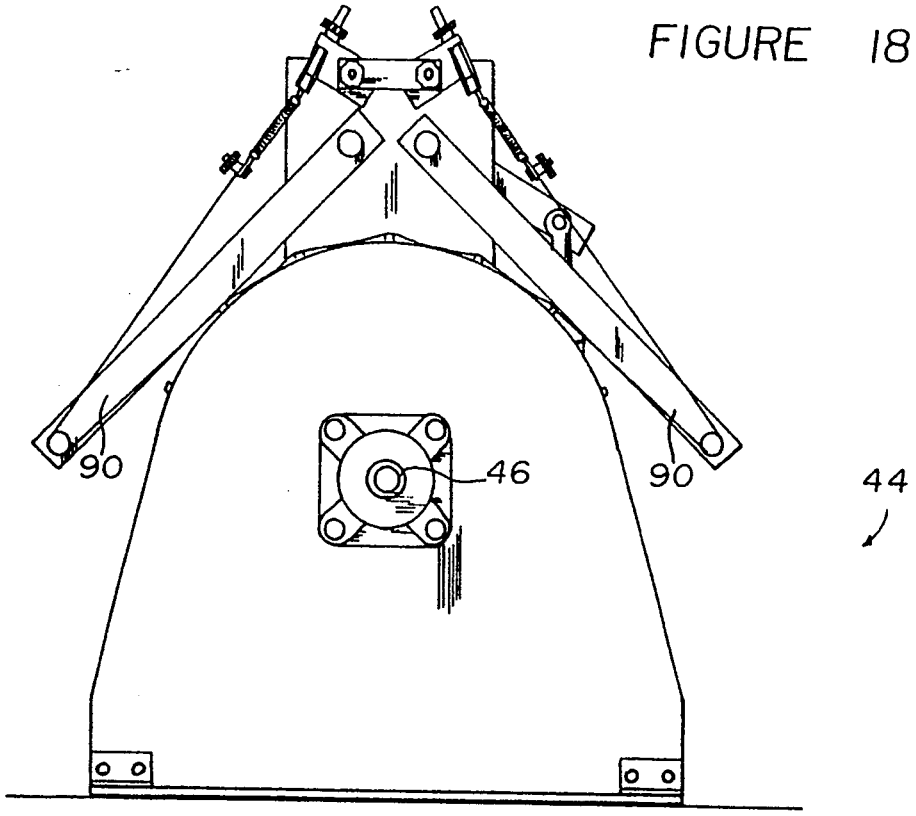
FIG. 18 is an enlarged side view of the squirrel cage of the system.
Figure 19:
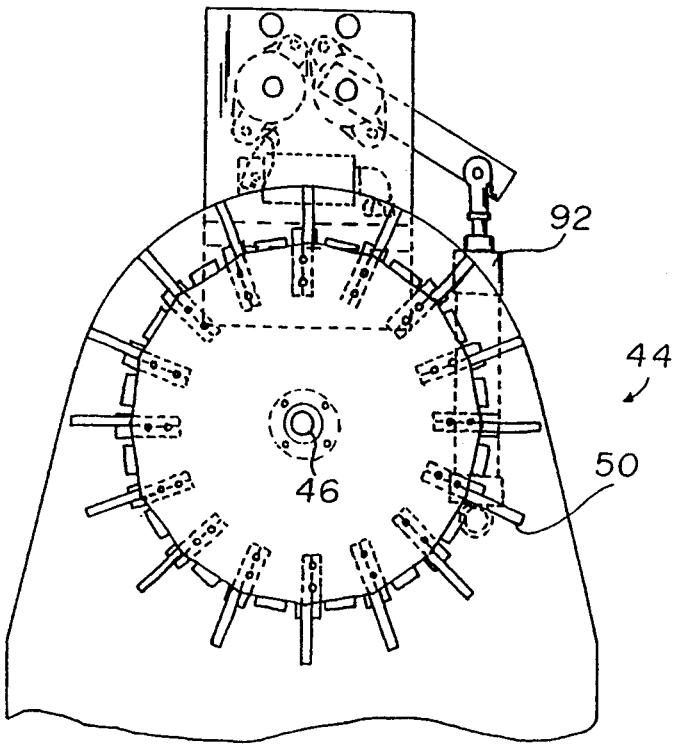
FIG. 19 is a side view of the squirrel cage with portions broken away to show an alignment and control wheel thereof.
Figure 20:
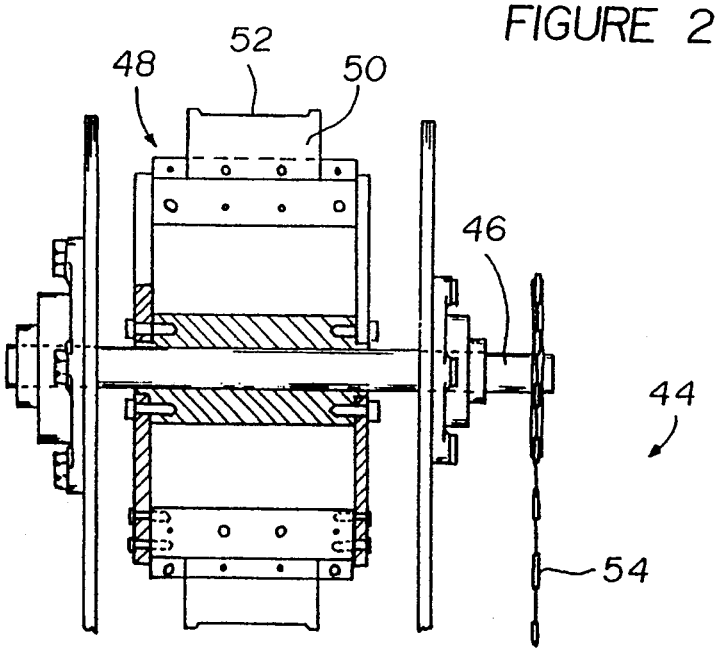
FIG. 20 is a side view of the wheel of FIG. 19 showing a central alignment groove within radially extending paddles of the wheel.
Figure 21:
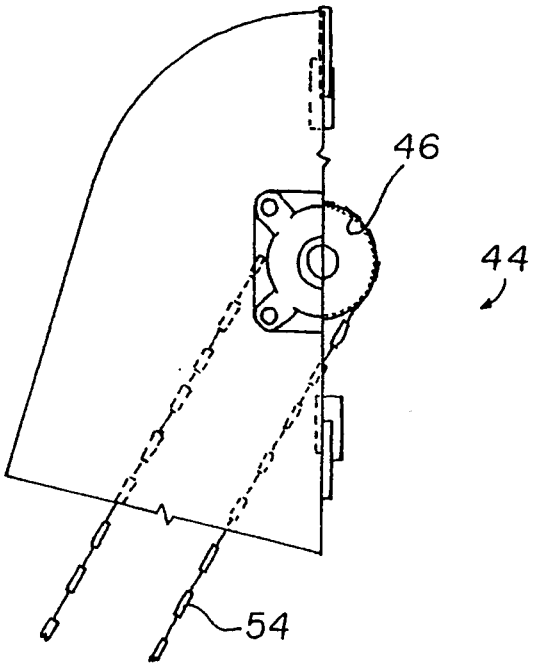
FIG. 21 shows the squirrel cage to be chain driven.

Turning briefly to FIGS. 18 and 19, it will be seen that each squirrel cage 44 includes retractable pressure arms 90 which act synchronously to place a slight pressure against wheel paddles 50 to maintain a taut engagement of the packages 18, so no slack forms in the strip 16.

Disengagement of the arms 90 is created by activation of an hydraulic mechanism 92 which acts to simultaneously raise or lower the arms 90, as desired.

It will be further understood that the squirrel cage can also act as a counter for the apparatus 10 if such function is desired.

In FIG. 22 is shown a simple block diagram showing the various interconnections between sensors of the apparatus 10, a programmable logic controller 100 thereof, and the controlled structures.

The programmable logic controller 100 may be generic, as may the sensors and activators, so long as the packaging, filling and sealing stations 12, 20 and 26, respectively are coordinated to function as a single unit and so long as the cutting and cartoning stations 28 and 32 are also operated as a single coordinated unit. Speed sensors 104 and 106 for the pouch machine 12 and cartoner 32, respectively, may be recognized as simple tachometers, with output from the pouch machine tachometer 104 being fed to a cartoner controller 108, to allow for correspondence of function between the two ends of the apparatus 10.

In the circuitry 40, there is also required input from and output to the chosen accumulator, 60 or 70, in the disclosed embodiments. Input is provided by means of any suitable sensor 110, and output from the programmable logic controller 100 is directed to the chosen drive mechanism for same.

Although only the knife drive 120 is shown here to be in operative engagement with the tachometer 106, it will be understood that a cartoner drive (not shown) is also coordinated into the circuit, perhaps through secondary use of the tachometer 106, to cause shutdown of the cutting station 28 upon stoppage of the cartoning station 32.

To complete the circuit, a pouch machine running signal 112 is fed to the programmable control logic 100 and output from the logic 100 is directed to a speed select relay 114 for controlling package production speed during cartoner 32' downtime.

The programmable logic controller 100 is as simply programmed as possible, a shown, and such programming may be accomplished in known manner to provide a simple yet elegant packaging apparatus 100.

It will be understood that each station, including the accumulation station, as well as the control system for the apparatus 10, may incorporate generic structure different from those precisely disclosed herein, with only the novel combination and sequencing of elements being critical. Thus, a restriction should not be placed on the teaching herein by a strict conformation to the particular elements disclosed in the particular embodiment shown.

Further, although the downstream end of the packaging apparatus 10 has been shown in the chosen embodiment to include a cartoner 32', it will be understood that this is not to be consideed limiting inasmuch as other structures, such as, for example, an overwrapper, a bag machine, or any other station used for completion of a finished package may be incorporated in place thereof. So long as the accumulator 60 or 70 is positioned between the packaging station 12 and the cutting station 28, any downstream processor may be accommodated by the apparatus 10.

As described above, the accumulator structure incorporated into the packaging apparatus 10 provides a number of advantages, some of which have been described above and others of which are inherent in the invention. Also, modifications can be proposed to the structure disclosed herein without departing from the teachings herein. Accordingly, the scope of the invention is only to be limited as necessitated by the accompanying claims.

We claim:

1. A method of accumulating packages upstream of a downstream processing apparatus of a packaging machine upon stoppage of said downstream processing apparatus, said method comprising the steps of:

creating chained packages of product;

feeding said packages into and through a control apparatus which is operable at a rate corresponding to a chosen rate of package creation;

said control apparatus supplying said chained packages onto an accumulator structure;

said packages feeding from said accumulator to a cutting station which severs the chained packages apart;

said severed packages being supplied to a downstream processing apparatus; and shutting down operation of said cutting station on discontinuance of operation of said downstream processing apparatus and accumulating uncut chained packages upon said accumulator for a predetermined time period; and decreasing package production rate to increase the time period for accumulation.

2. The method of claim 1 further including the steps of:

increasing the rate of cutting and processing by said downstream processing apparatus until accumulated packages on said accumulator are processed by said downstream processing apparatus; and then returning to a rate of cutting and processing by said downstream processing apparatus corresponding to the chosen rate of package production.

3. The method of claim 2 further including the step of returning package production to the chosen rate of the production rate was decreased to accommodate accumulation.

4. The method of claim 3 wherein all steps are controlled by computer circuitry.

5. In a packaging apparatus of the type including a packaging station, a cutting station for separating packages produced in chain fashion in the packaging station, the improvement comprising: an accumulator structure functionally engaged between an outlet form the packaging station and an inlet to said cutting station for accumulating thereon, any overflow of chained packages created in the packaging station, within predefined limits, until such overflow is accomodated, wherein said accumulator comprises a conveyor type structure upon which loops of uncut packages are supported.

6. The apparatus of claim 5 wherein a control apparatus for the conveyor type structure mounted at the outlet of the packaging station, engages package exiting therefrom and feeds same onto the conveyor.

7. The apparatus of claim 6 wherein said control apparatus comprises a squirrel cage which includes a paddle which therein, the paddle wheel having a plurality of radially disposed paddles thereon, with each paddle having a centered radial end edge notch therein, such notch accommodating engagement of a package therein.

8. The apparatus of claim 7 wherein motion of said paddle wheel is correlated to rate of package production at said packaging station.

9. The apparatus of claim 8 wherein the speed of the conveyor being variable under circuitry control.

10. The apparatus of claim 9 wherein cutting station activation is correlated to packaging station activity under circuitry control.

11. The apparatus of claim 10 wherein said conveyor type structure comprises a driven conveyor belt.

12. The apparatus of claim 10 wherein said conveyor type structure comprises a driven runged closed loop conveyor, the conveyor being supported on a framework, rungs of said conveyor each engaging a variable length loop of chained packages thereover across a top flight of said conveyor, said chained packages thereover fed onto and removed from said rungs via control apparatus positioned over said top flight of said conveyor.

13. The apparatus of claim 12 wherein said control apparatus at a rung feed end of said top flight of said conveyor is stationary.

14. The apparatus of claim 13 wherein said control apparatus at an exit end of said top flight of said conveyor is movable over said top flight, movement thereof being circuitry controlled to eliminate any potential pulling apart of the chained packages by stress created between the two control apparatus of the accumulator.

15. The apparatus of claim 11 wherein said driven conveyor belt is comprised of parallel bands supported on end shafts upon which loops of claimed packages are received.

16. The apparatus of claim 15 wherein said conveyor belt is laterally framed by alignment shoulders for maintaining the chain of packages aligned on the belt.

17. A method of creating packages in a packaging machine, comprising:

creating chained packages at a predetermined rate, supplying said chained packages to an accumulator, supplying said chained packages from said accumulator to a cutting station for separating said packages, varying the speed of operation of said cutting station in response to the accumulation of said chains of packages on said accumulator.

18. A method of creating packages in a packaging machine as claimed in claim 17 including increasing the speed of operation of said cutting station to exceed the rate of package production.

19. A method of creating packages in a packaging machine, comprising:

creating chained packages at a predetermined rate;

supplying said chained packages to a cutting station for separating said packages;

varying the speed of operation of said cutting station relative to the rate of package production.

20. A method of creating packages as claimed in claim 19 including increasing the speed of operation of said cutting station to exceed the rate of package production.

21. A method of creating packages in a packaging machined as claimed in claim 20 including decreasing the rate of package production for a period of time and thereafter returning the same to the predetermined rate.

22. In a packaging apparatus to the type including a packaging station, a cutting station for separating packages produced in chain fashion in the packaging station, and a downstream processing apparatus for processing separated packages, the improvement comprising; an accumulator structure functionally engaged between an outlet from the packaging station and an inlet to said cutting station for accumulating thereon, any overflow of chained packages created in the packaging station, within predefined limits, until such overflow is accomodated by said downstream processing means, such as during times of shutdown of said downstream processing apparatus, wherein said accumulator comprises a conveyor type structure upon which loops of uncut packages are supported.

23. The apparatus of claim 22 wherein a control apparatus for the conveyor type structure mounted at the outlet of the packaging station, engages packages exiting therefrom and feeds same onto the conveyor.

24. The apparatus of claim 23 wherein said control apparatus comprises a squirrel cage which includes a paddle wheel therein, the paddle wheel having a plurality of radially disposed paddles thereon, with each paddle having a centered radial end edge notch therein, such notch accommodating engagement of a package therein.

25. The apparatus of claim 24 wherein motion of said paddle wheel is correlated to rate of package production at said packaging station.

26. The apparatus of claim 25 wherein said paddle wheel feeds the chain of packages to said accumulator structure, said accumulator structure comprising a conveyor type arrangement which is movable to carry packages supported thereon from said paddle wheel to said cutting station.

27. The apparatus of claim 26 wherein cutting station activation is correlated to packaging station activity.

28. The apparatus of claim 27 wherein said conveyor type structure comprises a driven conveyor belt.

29. The apparatus of claim 28 wherein said driven conveyor belt is comprised of parallel bands supported on end shafts upon which loops of chained packages are received.

30. The apparatus of claim 29 wherein said conveyor belt is laterally framed by alignment shoulders for maintaining the chain of packages aligned on the belt.

31. The apparatus of claim 27 wherein said conveyor type structure comprises a driven runged closed loop conveyor, the conveyor being supported on a framework, rungs of said conveyor each engaging a variable length loop of chained packages thereover across a top flight of said conveyor, said chained packages being fed onto and removed from said rungs via control apparatus positioned over said top flight of said conveyor.

32. The apparatus of claim 31 wherein said control apparatus at a rung feed end of said top flight of said conveyor is stationary.

33. The apparatus of claim 32 wherein said control apparatus at an exit end of said top flight of said conveyor is movable over said top flight, movement thereof eliminating any potential pulling apart of the chained packages by stress created between the two control apparatus of the accumulator.

34. A packaging machine comprising:

a.) a packaging apparatus for forming a chain of connected packages;

b.) a cutting station to separate packages from said chain, including a controllable, variable speed drive;

c.) sensing means to sense the speed of said packaging apparatus;

d.) control means associated with said sensing means and said cutting station drive responsive to the speed of operation of said packaging apparatus to vary the speed of operation of said cutting station relative to the speed of operation of said packaging apparatus.

35. A packaging machine as claimed in claim 34 wherein said machine includes a control device for creating a continuous chain of spaced packages comprising a generally cylindrical wheel mounted for rotation, the outer periphery being divided into a plurality of segments by means defining transverse radial edges, the spacing of said edges corresponding to the spacing between packages.

36. A packaging machine as claimed in claim 34 wherein said cutting station is remote from said packaging apparatus.

37. A packaging machine as claimed in claim 36 wherein an accumulator is interposed between said packaging apparatus and said cutting station to accumulate said chain of connected packages formed by said packaging apparatus prior to entering said cutting station.

38. A packaging machine as claimed in claim 36, including sensing means associated with said control means to sense the accumulation of said chain of packages on said accumulator, said control means being responsive to said sensing means sensing the accumulation of said chain of packages on said accumulator to adjust the speed of said cutting station to reduce the accumulation of said chain of packages on said accumulator.

39. A packaging machine as claimed in claim 38 wherein additional equipment adapted to perform further operations upon separated packages is disposed downstream of said cutting station, said packaging machine including sensing means to sense the condition of operation of said downstream equipment, said control means being responsive to said means sensing the condition of operation of said downstream equipment to shut down operation of said cutting station on shut down of said downstream equipment.

40. A packaging machine as claimed in claim 38 wherein said packaging apparatus includes a controllable drive, said machine further including means associated with said control means to sense the condition of operation of said cutting station, said control means being responsive to shut down of said cutting station to reduce the speed of operation of said packaging apparatus.

41. A packaging machine as claimed in claim 40 wherein additional equipment adapted to perform further operations upon separated packages is disposed downstream of said cutting station, said packaging machine including sensing means to sense the condition of operation of said downstream equipment, said control means being responsive to said means sensing the condition of operation of said downstream equipment to shut down operation of said cutting station on shut down of said downstream equipment.

42. A packaging machine as claimed in claim 38 wherein said accumulator comprises a conveyor which advances from said packaging apparatus toward said cutting station.

43. A packaging machine as claimed in claim 42, including means to control the speed of advancement of said conveyor, said control means being associated therewith and being responsive to the accumulation of packages on said conveyor to control the speed of advancement of said conveyor.

44. A packaging machine as claimed in claim 43 wherein said conveyor comprises a conveyor belt upon which loops of said chain of packages are received.

45. A packaging machine as claimed in claim 38 wherein said control means is adapted to vary the speed of operation of said cutting station from a speed lower than the speed of operation of said packaging apparatus to a speed of operation which exceeds the speed of operation of said packaging apparatus.

46. A packaging machine as claimed in claim 45 wherein said control means is responsive to the speed of operation of said packaging apparatus and the accumulation on said conveyor to adjust the speed of operation of said cutting station to exceed the speed of operation of said packaging apparatus.

47. A packaging machine as claimed in claim 35 wherein said wheel is driven by said machine at a speed such that a package of the chain of packages is deposited between adjacent transverse radial edge at the same rate as the rate packages are produced by said machine.

48. A packaging machine as claimed in claim 47 wherein said device includes pressure arms which place slight pressure against said traverses radial edges to maintain a taut engagement of the chain of packages and said traverses radial edges.

49. A packaging machine as claimed in claim 48 wherein said pressure arms are retractable.

50. A packaging machine as claimed in claim 35 wherein said cutting station in remote from said packaging apparatus.

51. A packaging machine as claimed in claim 47 wherein said cutting apparatus is remote form said packaging apparatus.

52. A packaging, machine comprising:

a.) a packaging apparatus for forming a chain of connected packages;

b.) a remote cutting station to separate packages from said chain including a controllable variable speed drive;

c.) an accumulator between said packaging apparatus and said cutting station to accumulate said chain of connected packages formed by said packaging apparatus prior to entering said cutting station;

d.) sensing means to sense the accumulation of packages on said accumulator;

e.) control means associated with said sensing means and said controllable variable speed drive responsive to accumulation of said chain of packages on said accumulator to vary the speed of operation of said cutting station.

53. A packaging machine as claimed in claim 52 wherein said accumulator comprises a conveyor which advances from said packaging apparatus toward said cutting station.

54. A packaging machine as claimed in claim 53, including means to control the speed of advancement of said conveyor, said control means being associated therewith and being responsive to the accumulation of packages on said conveyor to control the speed of advancement of said conveyor.

55. A packaging machine as claimed in claim 54, wherein said conveyor comprises a conveyor belt upon which loops of said chain of packages are received.

56. A packaging machine as claim in claim 52 wherein said control means is adapted to vary the speed of operation of said cutting station from a speed lower than the speed of operation of said packaging apparatus to a speed of operation which exceeds the speed of operation of said packaging apparatus.

57. A packaging machined as claimed in claim 56 wherein said machine includes sensing means associated with said control means to sense the speed of operation of said packaging apparatus, said control means is responsive to the speed of operation of said packaging apparatus and the accumulation on said conveyor to adjust the speed of operation of said cutting station to exceed the speed of operation of said packaging apparatus.

58. A packaging machine as claimed in claim 57 wherein additional equipment adapted to perform further operations upon said separate package is disposed downstream of said cutting station, said machine including sending means to sense the condition of operation of said downstream equipment, said control means being responsive to said means sensing the condition of operation of said downstream equipment to shut down operation of said cutting station on shut down of said downstream equipment.

59. A packaging machine as claimed in claim 58 wherein said packaging apparatus includes a controllable drive, and machine further including means associated with said control means to sense the condition of operation of said cutting station, said control means being responsive to shut down of said cutting station to reduce the speed of operation of said packaging apparatus.

60. A control device for a packaging machine for creating a continuous chain of spaced packaged comprising a generally cylindrical wheel mounted for rotation, the outer periphery being divided into a plurality of segments by means defining transverse radial edges, the spacing of said edges corresponding to the spacing between packages.

61. A control device for a packaging machine as claimed in claim 60 wherein said wheel is driven by said machine at a speed such that a package of the chain of packages is deposited between adjacent transverse radial edges at the same rate as the rate packages are produced by said machine.

62. A control device for a packaging machine as claimed in claim 60 wherein said device includes pressure arms which place slight pressure against said transverse radial edges to maintain a taut engagement of the chain of packages and said transverse radial edges.

63. A control device for a packaging machine as claimed in claim 62 wherein said pressure arms are retractable.

* * * * *